US011236561B2

(12) United States Patent
Wermann et al.

(10) Patent No.: US 11,236,561 B2
(45) **Date of Patent: *Feb. 1, 2022**

(54) FLOW DIVERTER

(71) Applicant: Saturn Machine Works Ltd., Edmonton (CA)

(72) Inventors: Bernard Wermann, Edmonton (CA); Patrick Folick, Edmonton (CA); Michael Lang, New Sarepta (CA)

(73) Assignee: Saturn Machine Works Ltd., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/653,949

(22) Filed: Oct. 15, 2019

(65) Prior Publication Data

US 2020/0040678 A1 Feb. 6, 2020

Related U.S. Application Data

(63) Continuation-in-part of application No. 15/808,843, filed on Nov. 9, 2017, now Pat. No. 10,900,304.

(30) Foreign Application Priority Data

Oct. 13, 2017 (CA) ..... CA 2982295
Oct. 15, 2018 (CA) ..... CA 3020846

(51) Int. Cl.
*E21B 21/08* (2006.01)

(52) U.S. Cl.
CPC ..... *E21B 21/08* (2013.01)

(58) Field of Classification Search
CPC ..... E21B 21/08; E21B 21/103; E21B 4/003; E21B 4/02
See application file for complete search history.

(56) References Cited

U.S. PATENT DOCUMENTS 4,263,936 A 4/1981 Brown
2013/0306318 A1* 11/2013 Frosell ..... E21B 41/0078 166/305.1
2015/0096809 A1* 4/2015 Kerstetter ..... E21B 4/003 175/100

OTHER PUBLICATIONS

Drilling Motor Handbook, 2015 Edition Rev. A, Toro Downhole Tools, Tomball, Texas, US, 38 pages.
Information Sheet for Adaptor, Bearing Mandrel 8.000 in ML, Part No. 01396792, Weatherford, Mar. 2013, 4 pages.

* cited by examiner

*Primary Examiner* — Caroline N Butcher
(74) *Attorney, Agent, or Firm* — Lowe Graham Jones PLLC

(57) ABSTRACT

A flow diverter for connecting a central bore to an outer conduit. The flow diverter defines a portion of the central bore and angled flow passages connecting the portion of the central bore to the outer conduit. Rounded edges between the central bore and angled flow passages reduce cavitation and/or turbulence. The rounded edges and an adjacent portion of the central bore may be defined by an insert. The insert may define walls extending fully around portions of the angled flow passages.

16 Claims, 16 Drawing Sheets

NEW SHEET

FLOW DIVERTER

PRIORITY CLAIM

This application claims priority from Canadian Patent Application No. 3020846 filed Oct. 15, 2018; and is a continuation-in-part of U.S. patent application Ser. No. 15/808,843 filed Nov. 9, 2017; which claims priority from Canadian Patent Application No. 2982295 filed Oct. 13, 2017, which applications are incorporated herein by reference in their entireties.

FIELD OF THE INVENTION

Flow diverter.

BACKGROUND OF THE INVENTION

A "flow diverter" refers to an element shaped to define one or more flow channels connecting a typically annular first conduit with a second conduit. One example context in which a flow diverter is used is in a drilling motor for powering a drill bit. Drilling mud flows through a bore to a power section of a drilling motor to power the drilling motor. The mud then flows through an annular conduit around a coupling between the power section and a bearing section. The flow is from power section to transmission (including drive shaft/cv joint) to bearing section and out the drill bit. The flow diverter connects the transmission to the bearing section. The annular conduit continues around an upper end of the bearing section. The bearing section has a central bore through which mud flows to lubricate the drill bit. The mud flows from the annular conduit to the central bore via a flow diverter having angled ports connecting the annular conduit to the bore. As the flow diverter is connected to the bearing section it is rotating with the bearing section at typically between 100-250 rpm. In some cases, there may be a flow diverter before the transmission on the upper end of a drive shaft in the transmission section for mud motors that can relieve pressure through a central bore in the power section's rotor. In this case the flow diverter would be connected at the flow channel end to the transmission of a drilling motor and at the bore end to a thru bore power section rotor. The flow direction would be reversed, with the flow coming through the bore and out the flow channels. However, the invention as claimed would serve in that location as well. Thus, a flow diverter handles mud flow around the transmission (drive shaft, cv joints) returning it to a central bore through the bearing section. Conventional flow diverter designs can have various angles of the ports relative to the bore, for example at 90 degrees, 45 degrees, or 30 degrees. The mud flow can be for example 200-600 gpm and there are typically 4 ports of diameter about 1". This flow of mud through the angled ports into the bore can result in washout in the walls of the diverter at or near the intersection of the bore and the ports. The diverter is typically scrapped when the walls are deemed compromised due to a certain amount of washout being present. These parameters are for 6½" motor parts, which is the size used in the flow simulations in this document. Different sized parts will result in different figures.

The example figures given above lead to an average flow speed of mud of about 20 to 60 ft/s through the 4 ports. According to Schlumberger Oilfield Glossary, "For erosion to occur usually requires a high fluid velocity, on the order of hundreds of feet per second, and some solids content, especially sand." The bore of a flow diverter may have a smaller total area than the ports, depending on the pressure and flow required by the mod motor or turbine. This can lead to a higher average flow speed in the bore than in the ports, but the speeds will typically remain below the hundreds of feet per second stated by Schlumberger to be needed for erosion. A person skilled in the art might therefore conclude that flow diverters should not wash out. Nonetheless, washout of the bore is observed to occur near the ports.

Due to the positioning of the washout near the ports, a cylindrical wear sleeve may not adequately protect a flow diverter from washout, and in any case might have to be replaced frequently due to the above mentioned washout occurring to the wear sleeve, with corresponding inconvenience and expense. Thus, there is a need for improved lifespan of flow diverters.

SUMMARY OF THE INVENTION

There is provided a flow diverter having bore walls defining a bore and inlet walls defining a flow channel acting as an inlet to the bore in use in the downhole drilling motor. The flow diverter is configured to direct an inlet fluid flow at an inlet flow rate into the bore via the flow channel and to direct a downstream flow at a downstream flow rate in a downstream direction within the bore downstream of the inlet. Transitional wall portions form a transition between the inlet walls and the bore walls at least in the downstream direction from the flow channel. The transitional wall portions are configured to be sufficiently smooth and to have sufficient radius of curvature to prevent cavitation within the bore at the transitional wall portions and immediately downstream of the transitional wall portions when fluid flows at the inlet flow rate into the bore via the flow channel and at the downstream flow rate in the downstream direction within the bore downstream of the flow channel. This can also be done with a reversed flow direction, in which case the parameters are chosen to prevent cavitation within the flow channel, which is downstream of the change in direction in this case.

In various embodiments, there may be included any one or more of the following features: the radius of curvature may be greater than one third of a diameter of the flow channel. The radius of curvature may be greater than one half of a diameter of the flow channel. The radius of curvature may be greater than three quarters of a diameter of the flow channel. The flow diverter may comprise a housing and an insert, the insert comprising the transitional wall portions, and the housing comprising the inlet walls or the bore walls. The insert may comprise the transitional wall portions and at least a portion of the bore walls downstream of the inlet, and the housing may comprise the inlet walls. The housing may comprise the inlet walls and the bore walls. The flow diverter may comprises a housing and an insert, the insert comprising the transitional wall portions and defining portions of the inlet walls extending fully around the flow channel. The flow channel may be one of plural flow channels defined by additional inlet walls, the inlet walls and the additional inlet walls converging to a point upstream of the bore to form a pyramid-shaped tip. A cross section of the pyramid-shaped tip parallel to the flow direction may have a concave profile. These features of the pyramid-shaped tip may also be present in the flow diverter even where there is no insert (although this would make it harder to manufacture). The flow channel may extends between the bore and an exterior surface of a tubular, the tubular having a first diameter at an upstream end of the tubular larger than a second diameter of the tubular at the flow channel, the tubular defining a transition area between the first diameter and the second diameter, the transition area having a slope of 45 degrees or less.

There is also provided a flow diverter having a body defining a central bore. The central bore has an opening at a first end of the body, and the body further defines flow channels angled relative to the central bore and connecting the central bore to an exterior surface of the body. The body also defines fillets connecting the flow channels to the central bore and having a radius of curvature greater than one third of a diameter of a flow channel of the flow channels.

In various embodiments, there may be included any one or more of the following features: the radius of curvature may be greater than one half of a diameter of the flow channel. The radius of curvature may be greater than three quarters of a diameter of the flow channel. the body may comprise a housing defining a cavity extending from the opening and an insert inserted within the cavity, the insert defining the fillets. The housing may be formed of a first material and the insert may be formed of a second material more abrasion resistant than the first material. There may be a first connector at the first end configured to connect the flow diverter to a bearing section of a drilling motor and a second connector at a second end opposite to the first end configured to connect the flow diverter to a coupling for connecting to a transmission of the drilling motor. There may be a first connector at the first end configured to connect the flow diverter to a transmission of a drilling motor and a second connector at a second end opposite to the first end configured to connect the flow diverter to a coupling for connecting to a through bore power section rotor of the drilling motor.

There is also provided an insert for a flow diverter, the insert defining a central bore and having curved portions adjacent to the central bore configured to, when the insert is inserted in the flow diverter, form fillets connecting the central bore to flow channels defined by the flow diverter, the flow channels being angled relative to the central bore and connecting the central bore to an exterior surface of the flow diverter when the insert is inserted in the flow diverter.

In various embodiments, there may be included any one or more of the following features: the insert may also have inlet wall portions extending fully around each of the flow channels. The inlet wall portions may converge to a point upstream of the central bore to form a pyramid-shaped tip. A cross section of the pyramid-shaped tip parallel to the flow direction may have a concave profile.

These and other aspects of the device are set out in the claims.

BRIEF DESCRIPTION OF THE DRAWINGS

Preferred and alternative examples of the present invention are described in detail below with reference to the following drawings:

FIG. 18 is a frame of a simulation showing flow in a closeup of a modified flow diverter having rounded connections between flow channels and bore and with a void behind the intersection of the flow channels and bore filled in;

DETAILED DESCRIPTION OF THE PREFERRED EMBODIMENT

Figure 1:
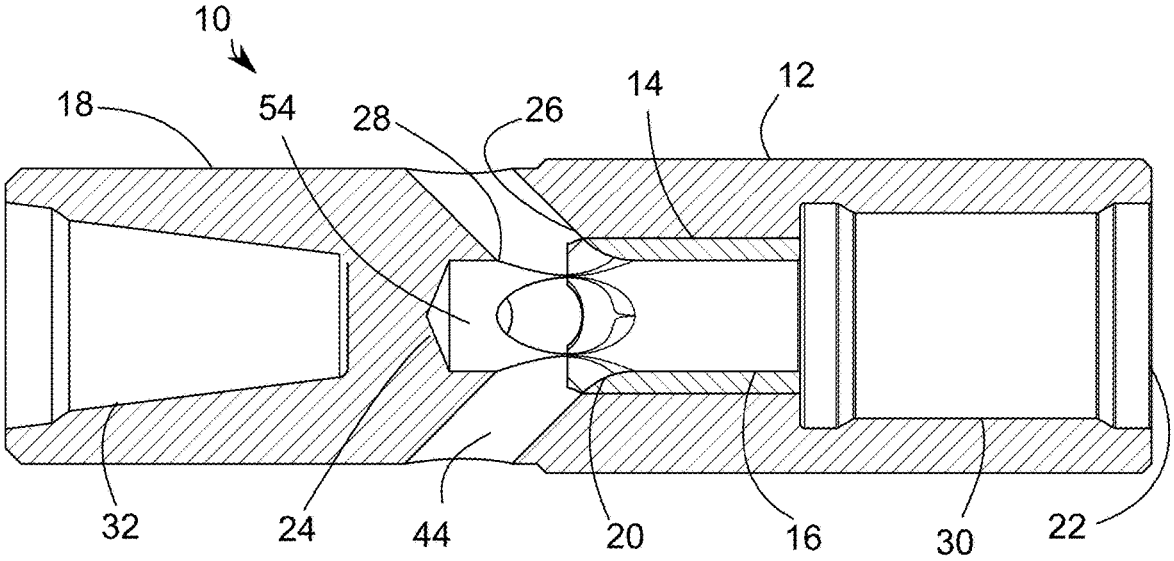
FIG. 1 is a side cutaway of a flow diverter.

The inventors believe that washout occurs in conventional flow diverters and other fluid handling mechanisms due to the turbulence and (hydrodynamic) cavitation caused as the fluid traverses an angle between the straight flow channel and straight bore. As fluid traverses a sharp angle where a wall diverges away from the incoming flow direction, it has momentum carrying it in its original direction resulting in a sharp pressure drop adjacent to the wall downstream of the angle. This pressure drop may be enhanced where the downstream wall is a boundary of a constricted channel where Bernoulli's principle applies, but the localized pressure immediately downstream of the angle at the wall may be well below the pressure expected from Bernoulli's principle given the average flow rate. The localized pressure drop can lead to cavitation at the wall shortly downstream of the angle. Due at least to turbulence, the cavitation is not steady but may repeatedly collapse leading to damage to the walls. Cavitation bubbles may also continue downstream and collapse leading to damage shortly downstream of the angle. Typically, there is additional equipment downstream of the flow diverter with the same central bore configuration, which will also benefit from the flow diverter embodiments disclosed here. Washout will occur in other fluid handling devices for the same reasons and thus the solution proposed below may also be applied to other applications where a wall diverges away from an incoming flow direction.

In order to reduce this disturbed fluid flow, there are therefore provided curved transition surfaces between the angled flow channels and the bore. The curved surfaces alter the flow at the exit point of the angled flow port or ports into the bore, creating a smoothed transition into the bore. The fluid traverses the angle gradually reducing the abrupt pressure drop at the walls present in a sharp transition. They also lower the fluid velocity creating a more gradual change in velocity and pressure at and beyond the transition. For the purpose of this document, these curved surfaces shaped to reduce cavitation and/or turbulence will be referred to as fillets. However, fabricating the fillets may pose challenges if the flow diverter is formed as one piece. For example, forming the fillets by machining would be difficult if not impossible in a one piece configuration. Thus, in an embodiment an insert is provided defining the fillets. The insert may also act as a wear sleeve which defines the bore at the intersection of the bore and flow channels, and immediately downstream of the intersection. An insert may also be inserted in an inlet flow channel and may define walls of the inlet flow channel and the fillet corresponding to the inlet flow channel. The insert may be made of a different material than the rest of the flow diverter. Thus the insert can be made out of various materials to provide the best possible wear resistance and part life for the conditions it is being used in. For example the insert may be made of a more abrasion resistant material to increase washout resistance. However, testing is showing that the same material as the housing is performing well with only the geometry modifications. The insert may also have various surface treatments including coatings and treatments that alter the surface texture to modify boundary layer conditions and/or the fluid interaction with the surface of the sleeve.

Figure 10:
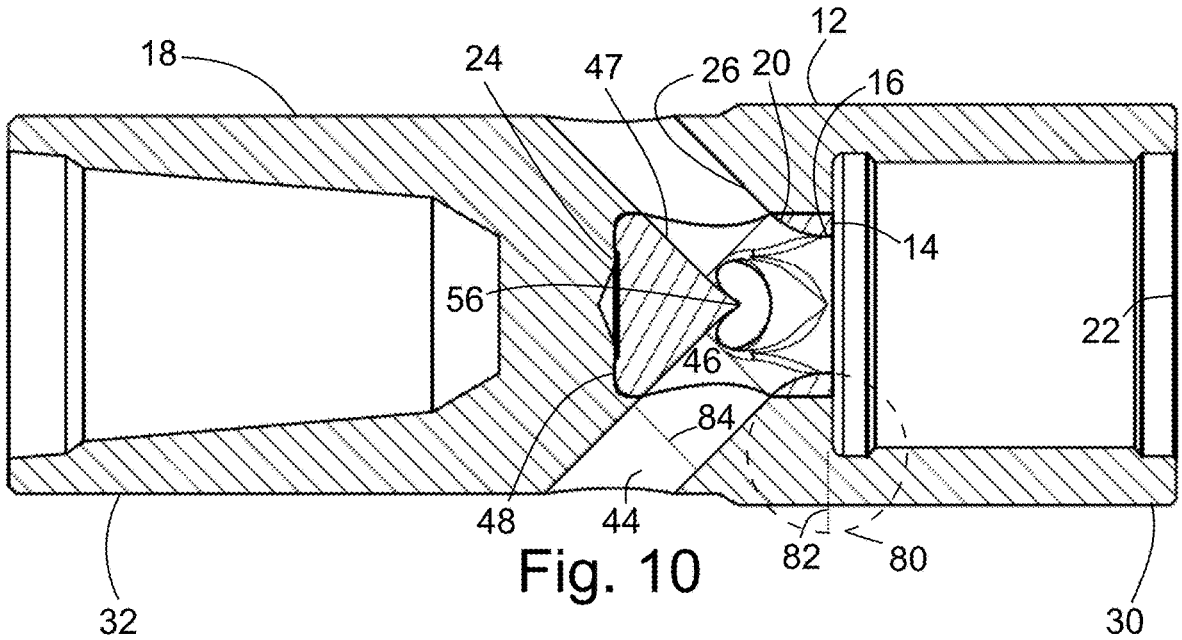
FIG. 10 is a side section view of a modified version of the flow diverter of FIG. 9 including an insert defining full portions of inlet channels.

The fillets may have an elliptical profile as seen in a cross section perpendicular to the flow. The fillets may have a radius that is variable based on the entry angle of the port. In the example shown in FIG. 10, dashed circle 80 with dotted radius line 82 represents the radius of curvature of a fillet 20 as seen in a cross section parallel to the flow. As can be seen in FIG. 10, the radius of curvature in this case is slightly less than a diameter 84 of the flow channels 44. For example, the radius of curvature 82 may in different embodiments be greater than ⅓, ½, or ¾ of the diameter 84. It could also be larger than the diameter 84. A profile need not correspond exactly to a portion of a circle to have a radius of curvature. Parameters of the profile may be chosen to mitigate cavitation.

An exemplary embodiment is described in relation to FIGS. 1-4.

FIG. 1 shows a side cross section of the exemplary embodiment of the flow diverter. As shown in FIG. 1, the flow diverter 10 comprises a body formed of a housing 12 and an insert 14. The body defines a central bore 16, a portion of the central bore being defined by insert 14, and the housing defines angled flow channels 44 connecting the central bore to an outer surface 18 of the housing. The insert defines curved surfaces 20 which form fillets in relation to the central bore and angled flow channels. The bore has an open end 22 and a closed end 24. The fillets connect to portions 26 of the angled flow channels positioned in a direction of intended flow from the angled flow channels into the bore, or if flow in the opposite direction occurred, positioned in a direction from which flow occurs from the bore into the angled flow channels. The portions 26 will thus be outer portions of the angled flow channels where the angled flow channels are at less than 90 degrees with respect to the bore, or portions closer to the open end of the bore where there is an open end and a closed end. In this embodiment, no fillets are present at opposite edges 28 which are away from the intended direction of flow from the angled flow channels into the bore. At the open end 22 there is a coupling 30 for coupling the flow diverter to a bearing section of a drilling motor. At the closed end 24 there is a coupling 32 for coupling the flow diverter to a coupling for connecting to a transmission of the drilling motor.

Figure 2A:
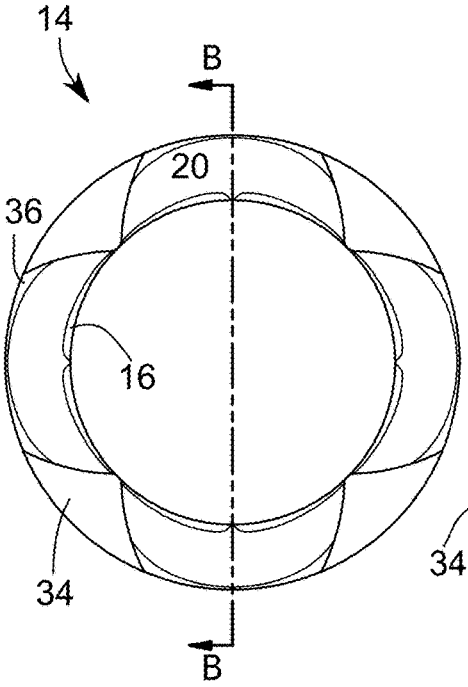
FIG. 2A is an end view of an insert in the flow diverter of FIG. 1.
Figure 2B:
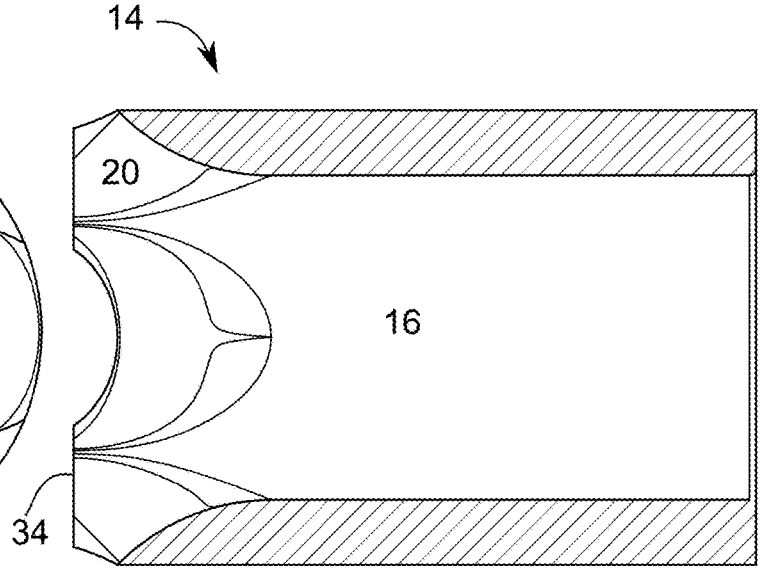
FIG. 2B is a side cutaway of the insert of FIG. 2A as cut on section lines B-B as shown in FIG. 2A, and is also a closeup of the insert as shown in FIG. 1.

FIG. 2*a* and FIG. 2B show the insert 14 more closely. FIG. 2A is an end view and FIG. 2B is a side cutaway view of the insert 14 showing fillets 20 and end portions 34 which contact the housing between the angled flow channels. In the embodiment shown, the fillets curve smoothly from the central bore 16 to portions 36 which are aligned with cylindrical walls of the angled flow channels when the insert is inserted into the housing.

Figure 3:
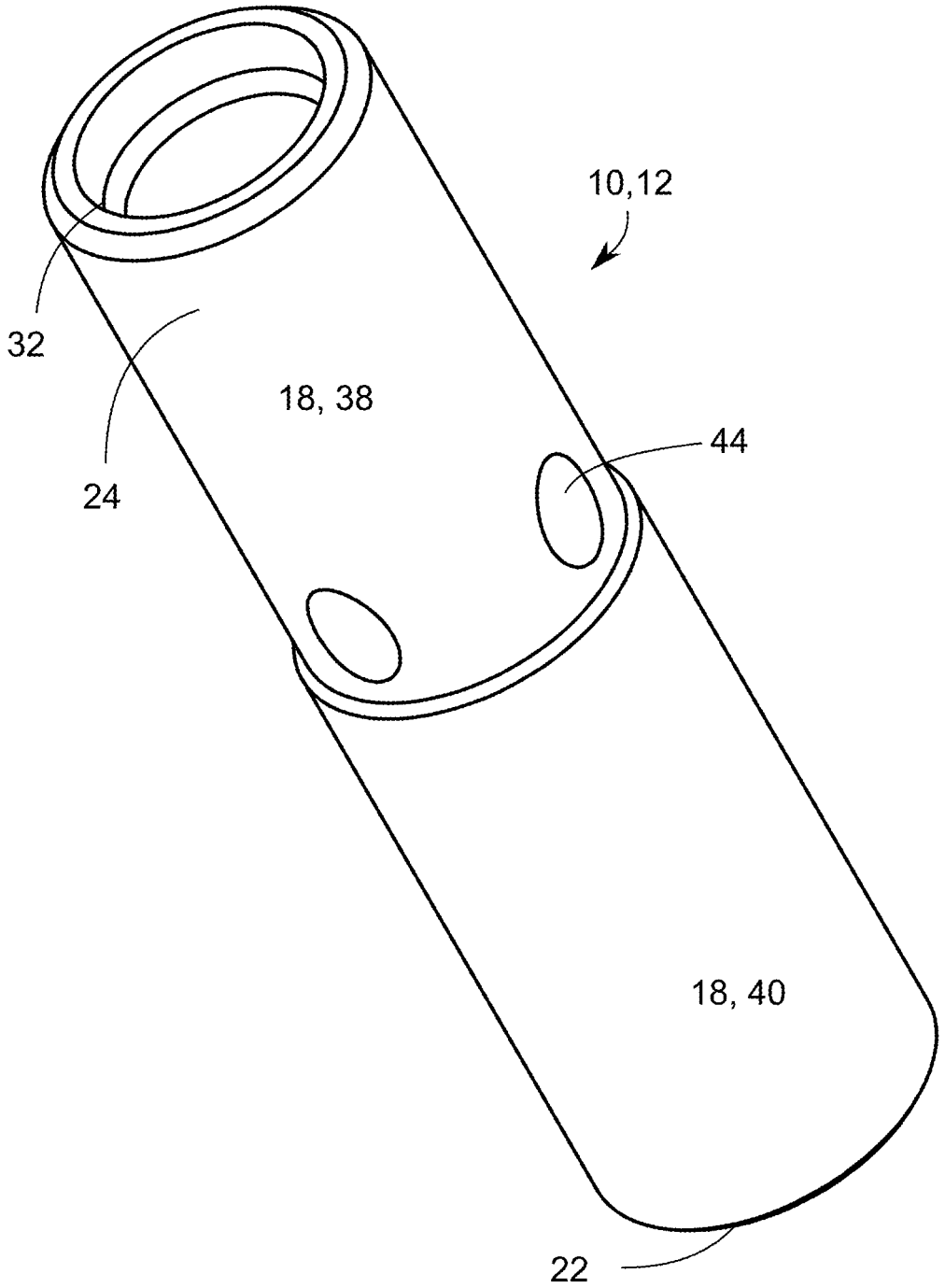
FIG. 3 is an isometric view of the flow diverter of FIG. 1.

FIG. 3 shows an isometric view of the flow diverter showing coupling 32 at closed end 24. The housing has a narrower portion 38 at closed end 24 and a wider portion 40 at open end 22. The outer surface of the housing at narrower portion 38 defines an inner boundary of an annular channel to which the angled flow channels 44 connect when the flow diverter is installed in a drilling motor.

Figure 4:
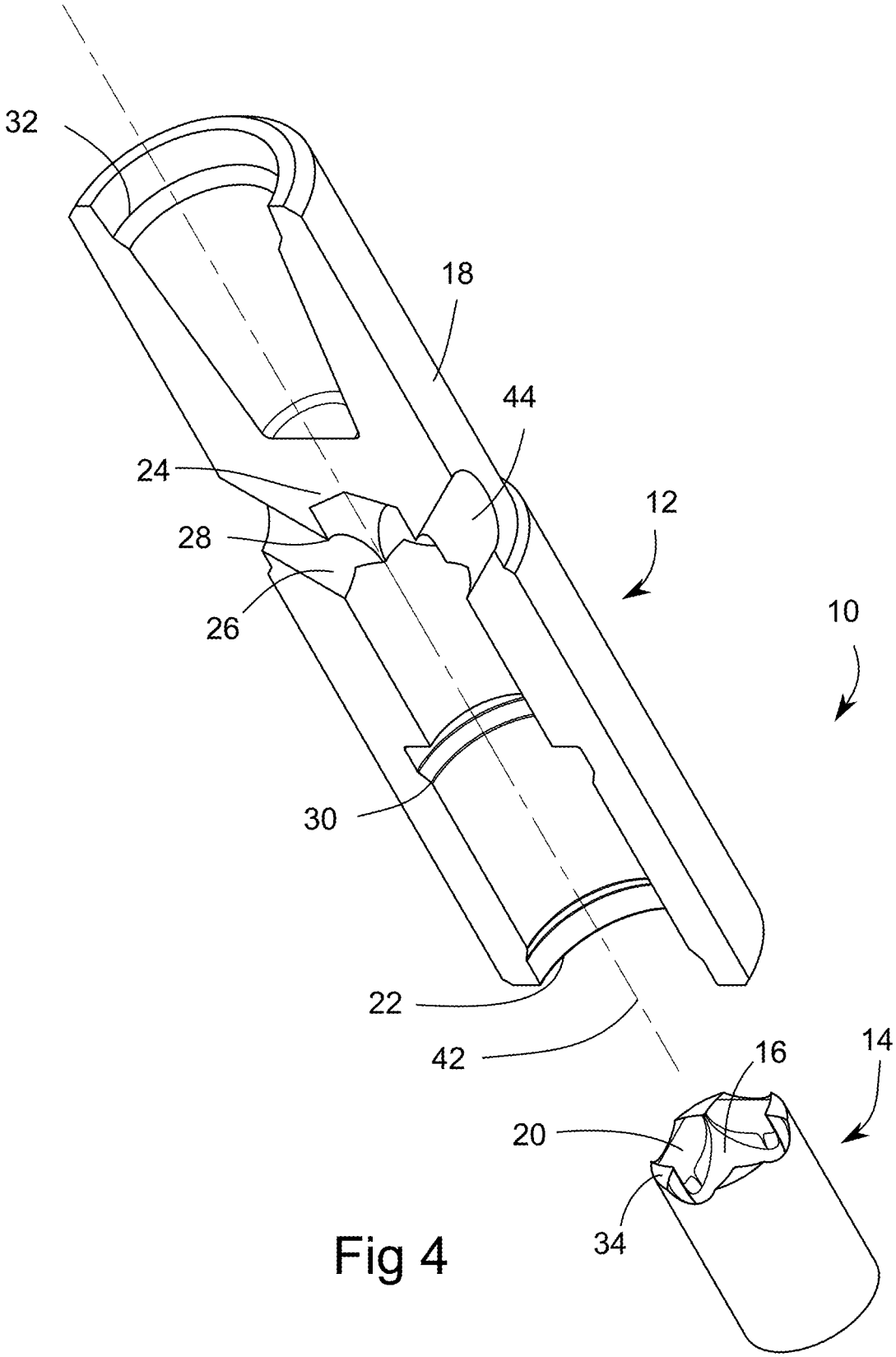
FIG. 4 is a cutaway exploded isometric view of the flow diverter of FIG. 1, with a dashed line showing a central axis along which the insert is displaced out of the flow diverter.

FIG. 4 shows a cutaway exploded isometric view of the flow diverter of FIG. 1. The insert 14 is shown displaced out of the flow diverter in the direction of the open end 22. Dashed line 42 shows a central axis along which the insert is displaced in this example.

Figure 5:
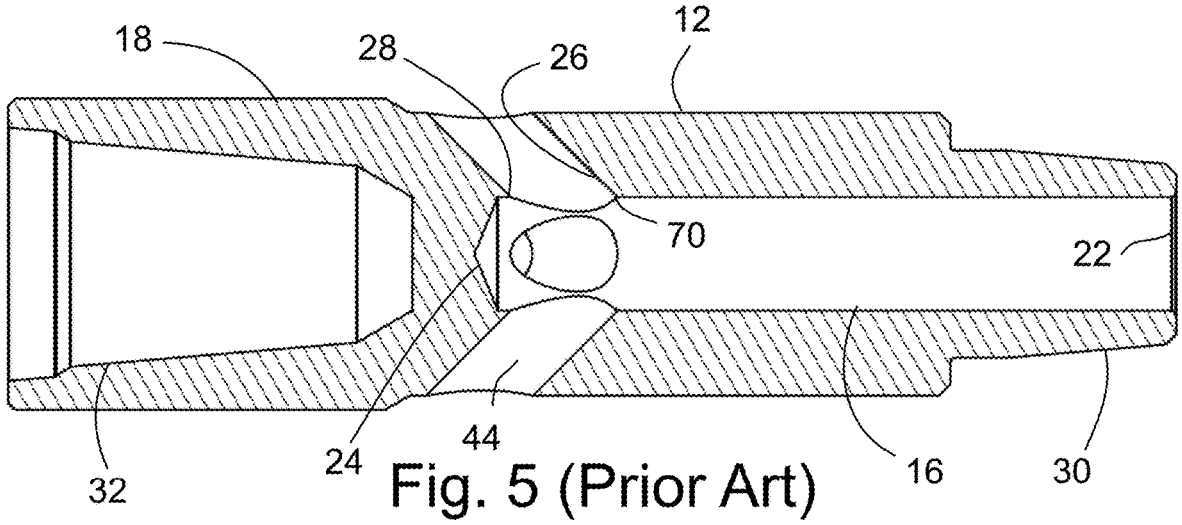
Fig. 5 (Prior Art)
FIG. 5 is a side section view of a prior art flow diverter having a long and thin outlet.

FIG. 5 shows a prior art flow diverter design. The open end coupling 30 for this flow diverter is a male connector, resulting in the portion of the central bore 16 downstream of the angled flow channels 44 being too long and narrow for it to be practical to modify the prior art diverter design to include an insert of the design disclosed in FIGS. 1-4. Also, in this diverter, the upstream end of the housing 12 is wider. The outer surface 18 of the housing 12 defines the inner boundary of an annular channel, including at the wider upstream end. Flow proceeds along this annular channel from left to right in this figure, until the flow reaches the angled flow channels 44. Beyond this point the annular channel continues but may be stagnant or reversing, as the flow is diverted to the central bore 16. As with all flow diverter designs shown in this document, in normal operation flow proceeds from the outer diameter 18, through the angled flow channels 44 and out the central bore 16.

Figure 6:
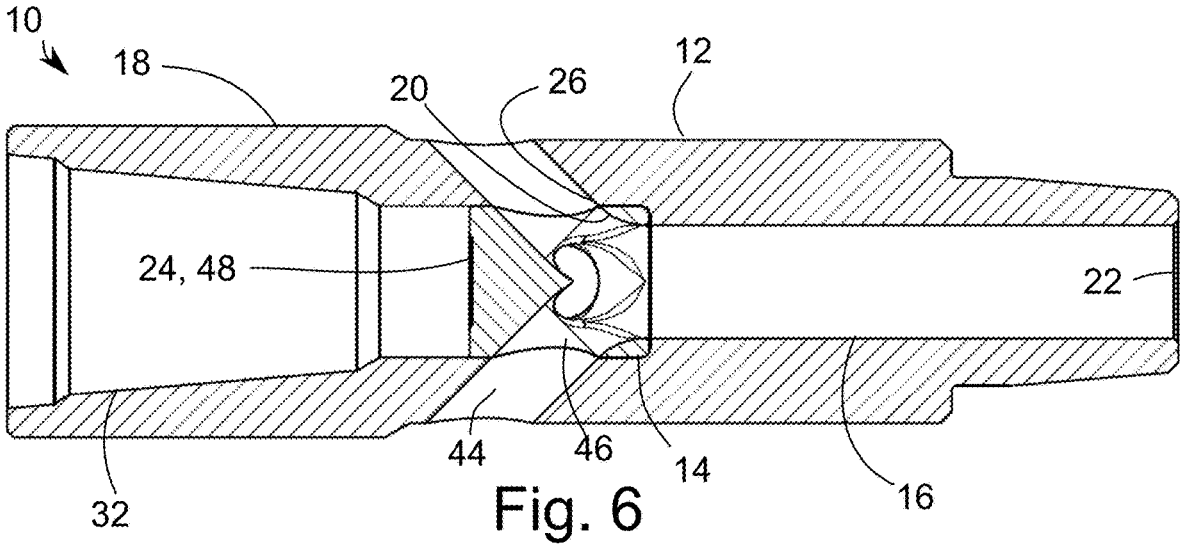
FIG. 6 is a side section view of a modified version of the flow diverter of FIG. 5 including an access opening from an upstream direction, and an insert that plugs the access opening in installed position.

FIG. 6 shows a modification of the prior art flow diverter design of FIG. 5 to include another embodiment of an insert 14. In this flow diverter embodiment, the insert 14 is inserted from the upstream ("closed") end 24 of the central bore 16. This insert defines walls 46 extending fully around, thus defining a portion of the length of, each of the angled flow channels 44. In some cases there is a sealed Constant Velocity drive joint (not shown in this figure, but shown in FIGS. 13-16) in place of an API threaded connection as the closed end connector 32. To prevent the joint from being exposed to the fluid pressure, the insert has a closed end portion 48 that acts to plug the central bore 16 to define the closed end of the central bore. Where such a fluid connection is not a concern, the closed end portion 48 could be omitted or include a hole (not shown). The shape of the closed end portion 48 as shown provides further benefits that will be described below in relation to FIGS. 10-12.

Figure 7:
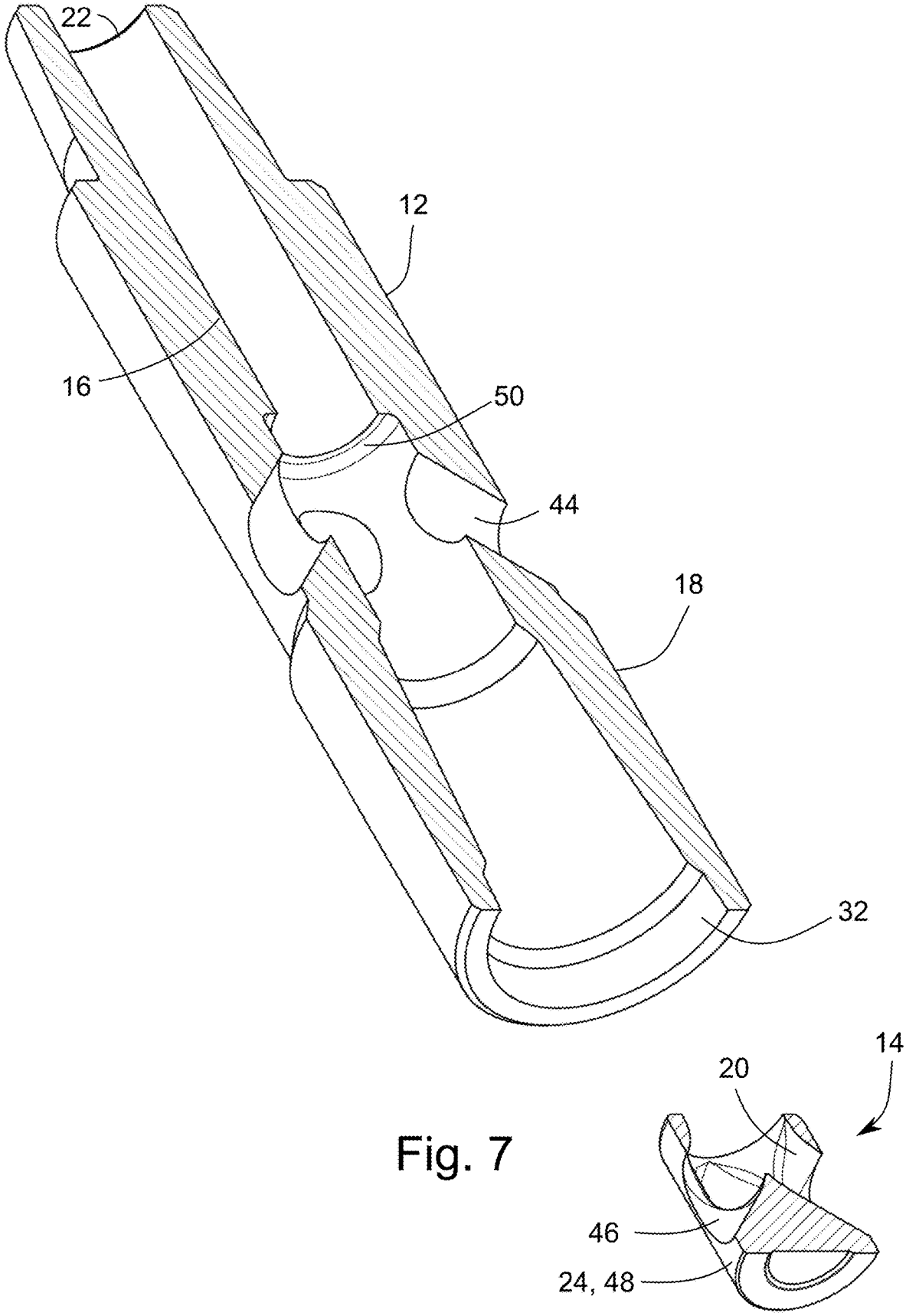
FIG. 7 is a cutaway exploded isometric view of the flow diverter and insert of FIG. 6.

FIG. 7 is a cutaway exploded isometric view of the flow diverter and insert of FIG. 6. The insert 14 in this embodiment is inserted into the housing 12 from the upstream end through coupling 32 to the transmission and comes to rest at seat 50.

Figure 8:
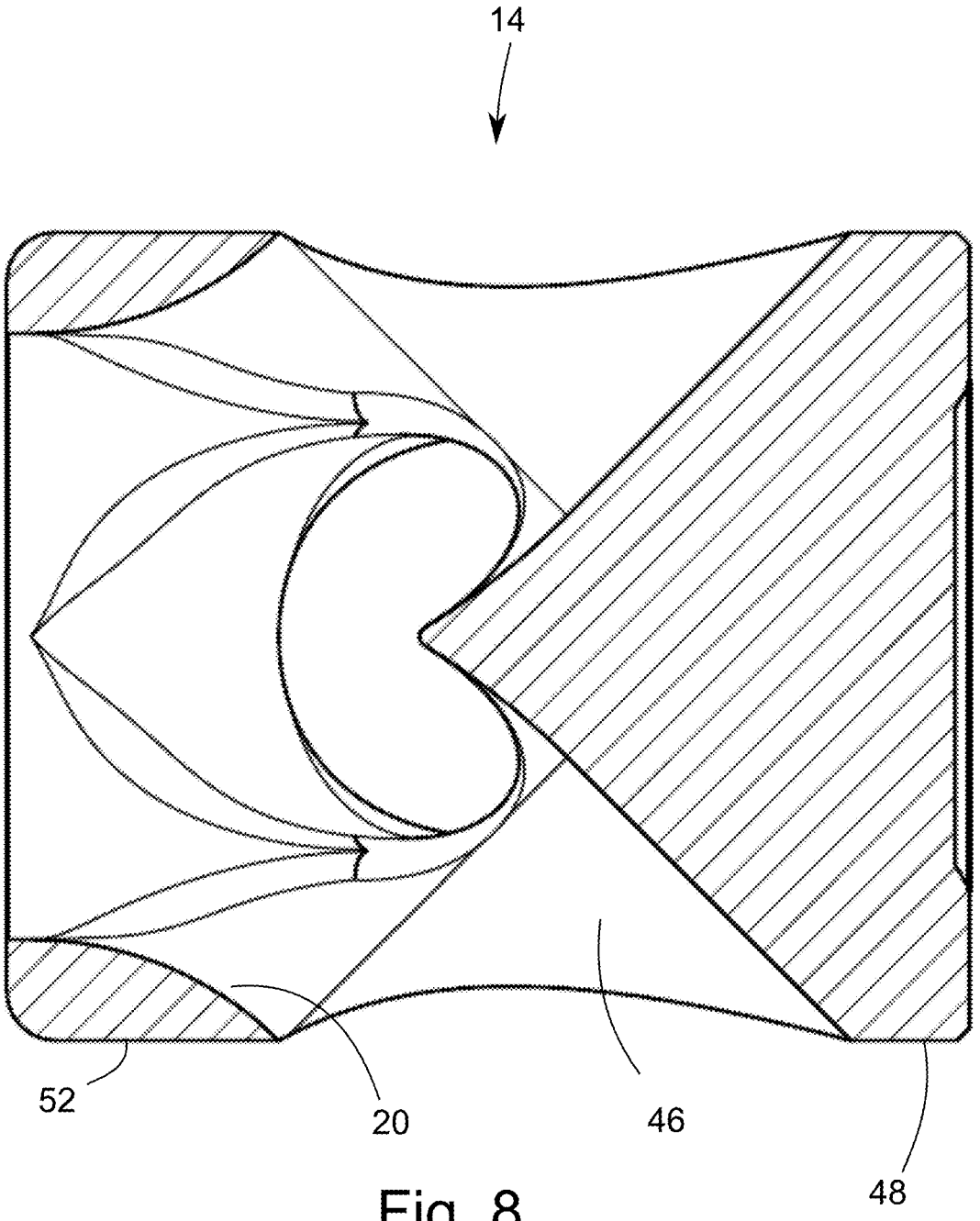
FIG. 8 is a closeup side section view of the insert for the modified flow diverter of FIG. 6.

FIG. 8 is a closeup side section view of the insert for the modified flow diverter of FIG. 6. The walls 46 defining the portion of the flow channels in the insert connect an open end portion 52 of the insert, defining curved surfaces 20, to the closed end portion 48.

Figure 9:
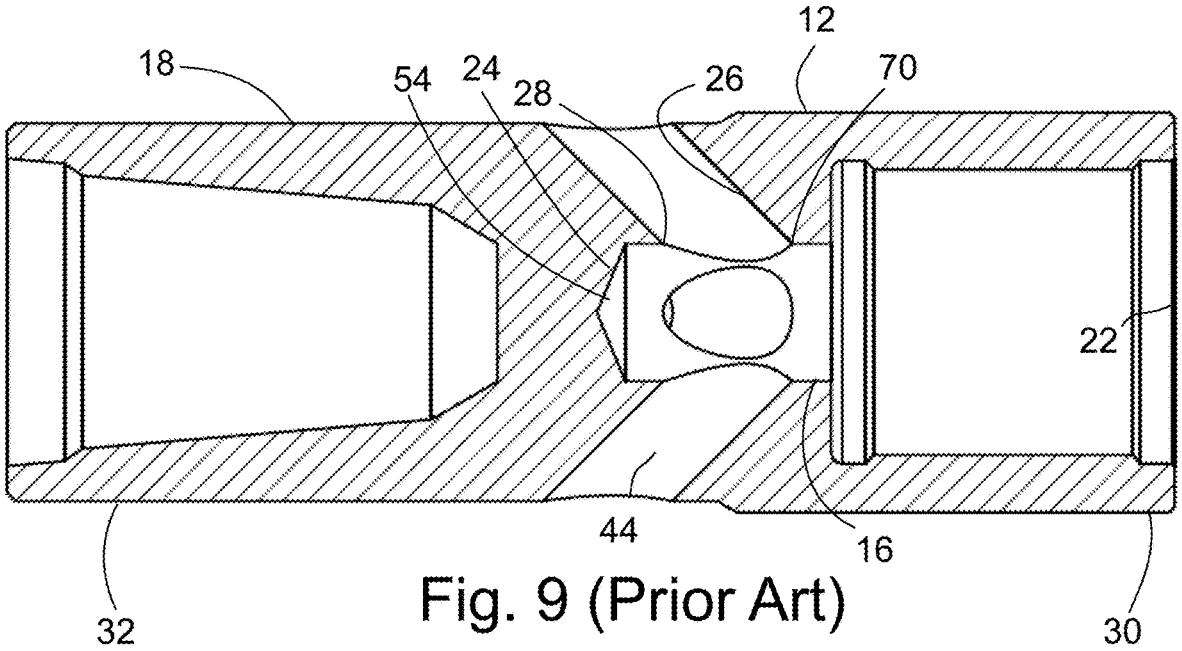
Fig. 9 (Prior Art)
FIG. 9 is a side section view of another prior art flow diverter.

FIG. 9 shows another prior art flow diverter. This diverter, as with the flow diverter of FIGS. 1-4, has a wide open end 22 of the bore 16 and can be modified to have an insert inserted from the open (downstream) end 22 and no plug is needed. This flow diverter could thus be modified to have an insert as shown in FIG. 1. However, in FIG. 10 a modified flow diverter is shown that has an insert 14 inserted from the right and a closed end portion 48.

The prior art flow diverter of FIG. 9 has no insert and is formed by machining the central bore 16 from the open end 22 beyond where the angled flow channels 44 will intersect, and drilling angled flow channels 44 to intersect the central bore 16.

Normal designs almost universally have allowance to drill past the angle port intersections which creates a void 54 behind the fluid flow. Such a void is also present in the embodiment of FIGS. 1-4. This void allows for turbulent recirculating flow which is believed to contribute to the potential for vortex cavitation, above that of the cavitation caused by the adverse pressure gradient at the angled port, central bore transitions. This vortex cavitation can manifest in damage locally and further downstream.

For the modified flow diverter shown in FIG. 10, the closed end portion 48 of the insert 14 includes closed end portions 47 of the walls 46 defining the portion of the flow channels in the insert. The closed end portion 48 of the insert narrows in this embodiment to a pyramid-shaped central tip 56 as the portions of the flow channels 44 defined by the insert converge.

The geometry of the insert 14 including the pyramid-shaped tip 56 is formed by simply extruding the angled flow channel along a swept path. This design effectively plugs the central bore 16 behind the fluid flow and significantly "smoothes" the fluid flow as it transitions from the angled ports 44 into the central bore 16.

The pyramid-shaped tip 56 is not expected to provide a significant benefit without the curved surfaces 20 between the central bore 16 and angled flow channels 44, as the tip 56 would likely only serve to maintain the fluid velocity further into the angled port/central bore transition, increasing the adverse pressure gradient. The tip 56 may in that case actually make things worse by forcing a larger volume of the fluid flow at a higher velocity closer to the 45° sharp transition.

Note that the velocity is highest in the central bore 16 exiting the part. The flow is accelerating through the angled flow channels 44 into the central bore 16, and we want that transition to be as smooth and gradual as possible.

Without an insert 14, a pyramidal shaped tip 56 at closed end 24 could be formed by simply drilling the flow channels 44 into a flow diverter that has had the central bore drilled to a specific distance. However, that would require matching the flow channel diameters to the central bore diameter so that the angled flow channels are drilled to intersect each other to eliminate any remnants.

Figure 11:
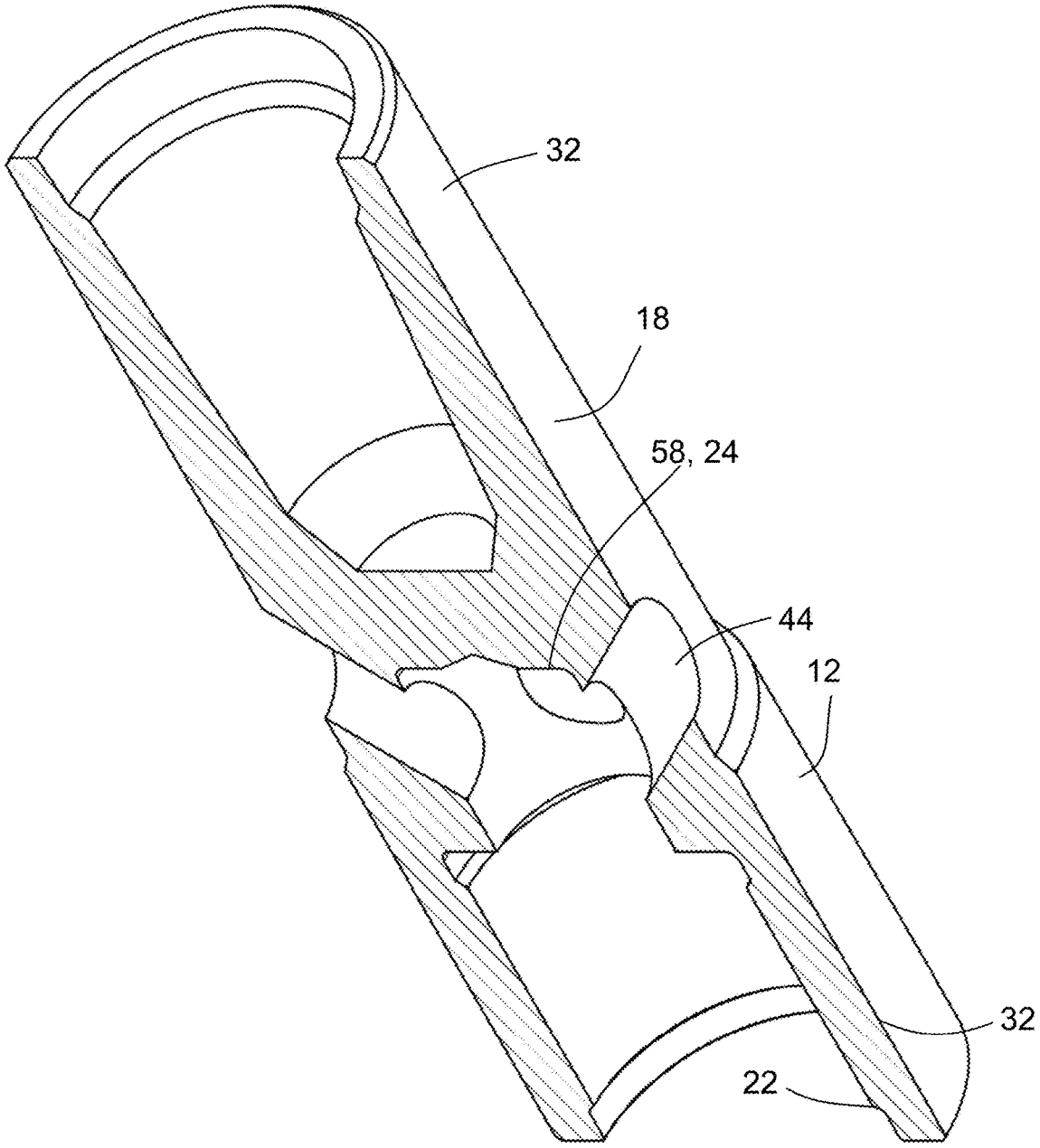
FIG. 11 is a cutaway exploded isometric view of the flow diverter and insert of FIG. 10.
Figure 11:
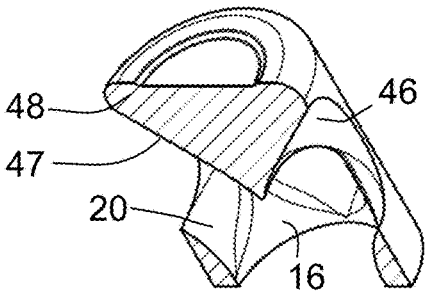

FIG. 11 is a cutaway exploded isometric view of the flow diverter and insert of FIG. 10. The insert 14 is inserted from open end 22 of the bore 16 and comes to rest at seat 58 at the closed end 24 of the bore.

Figure 12:
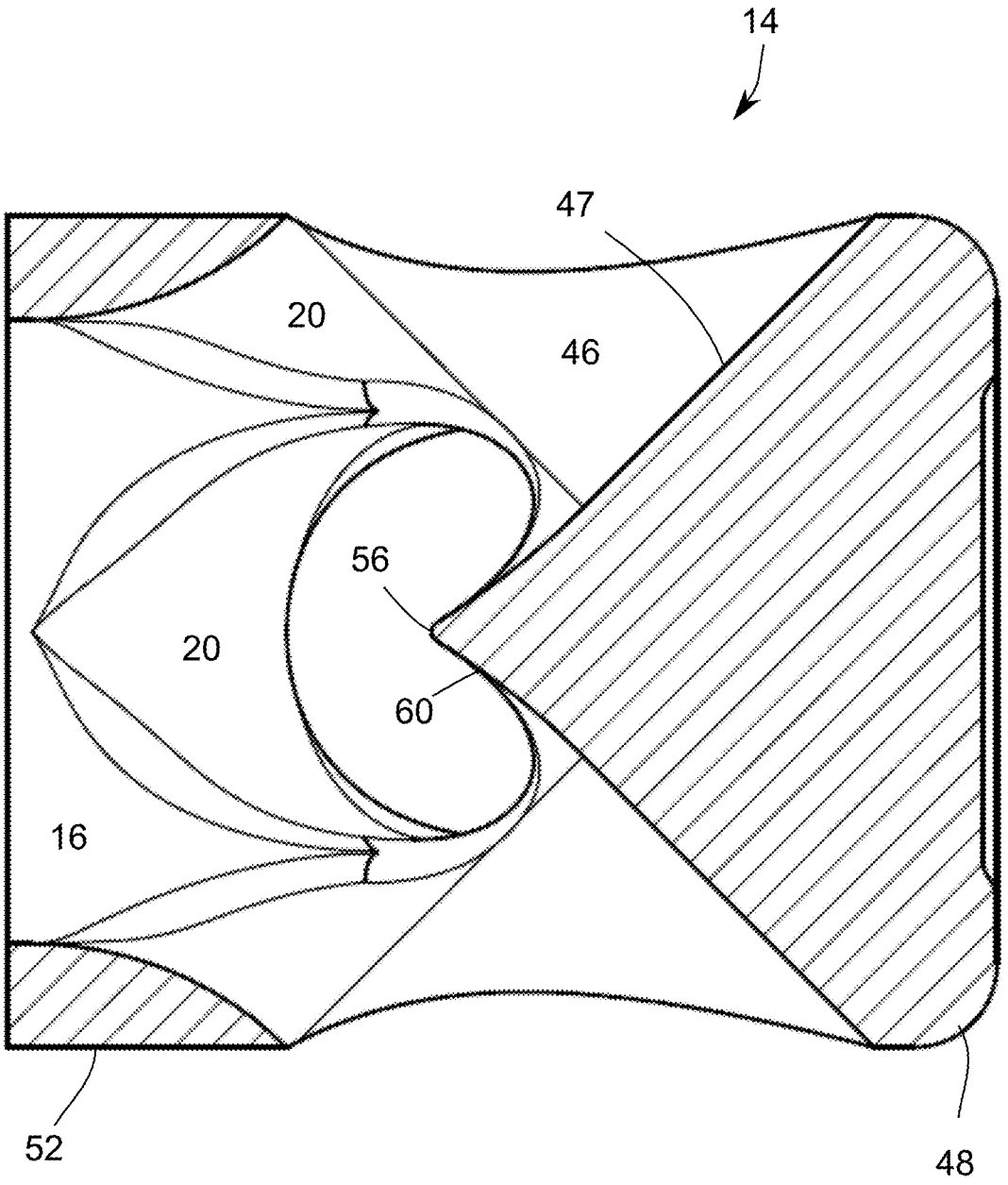
FIG. 12 is a closeup side section view of the insert for the modified flow diverter of FIG. 10.

FIG. 12 is a closeup side section view of the insert 14 for the modified flow diverter of FIG. 10. As shown in FIG. 12, the portions of angled flow channels 44 defined by the insert 14 are curved in this embodiment. This curvature is visible in a concave profile 60 of the cross section of the pyramid-shaped tip 56. The curvature is modeled by "sweeping" a cross section of the angled flow channel through a path from the center of the angled flow channel into the central bore at which point the "sweep" path is parallel to the central bore. This curvature is intended to maintain an even angled flow channel cross section for as long as possible. The curvature is believed to assist the fluid velocity transition into the central bore resulting in a more even velocity distribution through the transition over and above eliminating the turbulent backflow into the void 54 that is in the prior art (e.g. FIG. 9) behind the angled flow channels 44.

Figure 13:
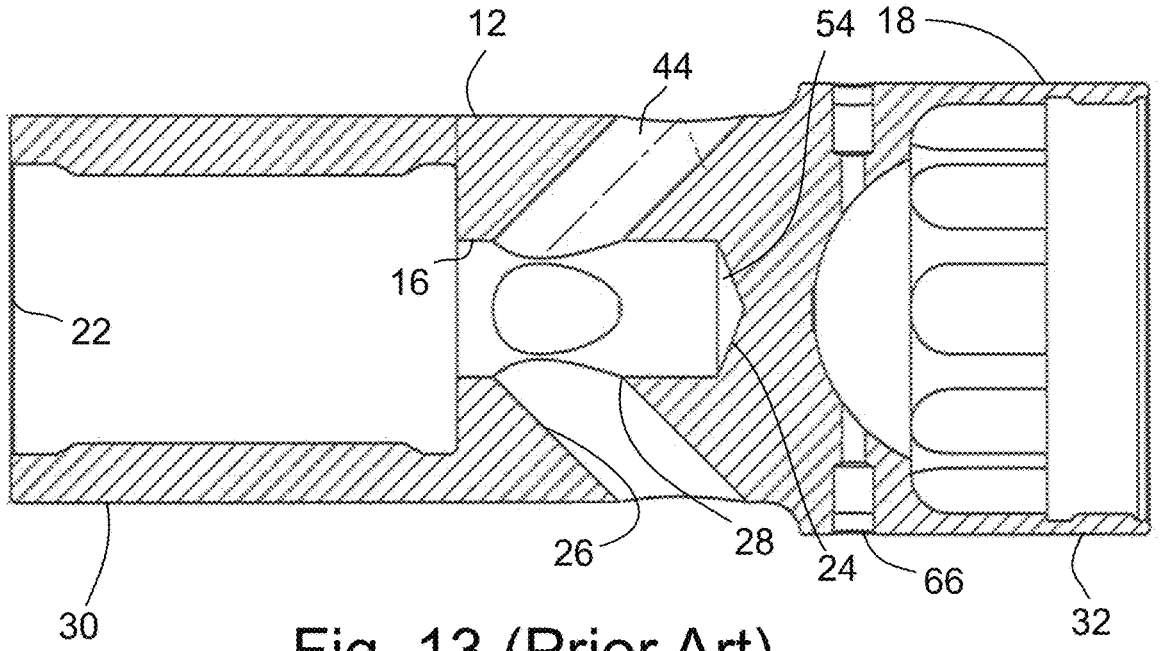
Fig. 13 (Prior Art)
FIG. 13 is a side section view of another prior art flow diverter.
Figure 14:
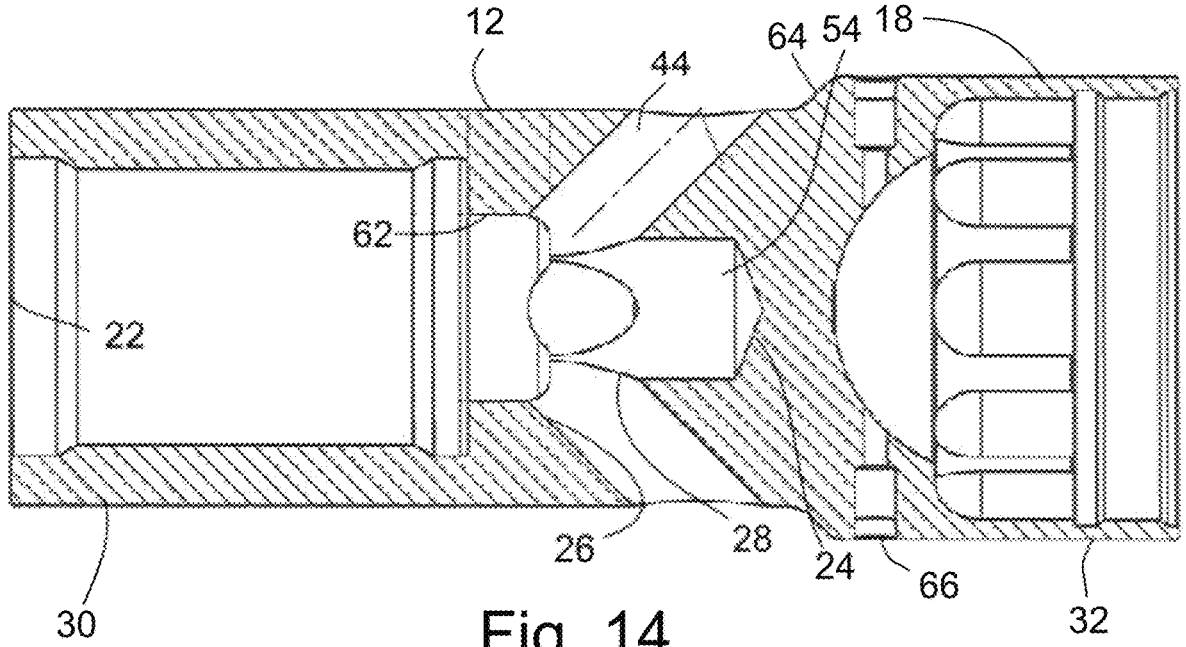
FIG. 14 is a side section view of a housing of a modified flow diverter based on the flow diverter of FIG. 13 showing a widening of the bore to receive an insert.
Figure 15:
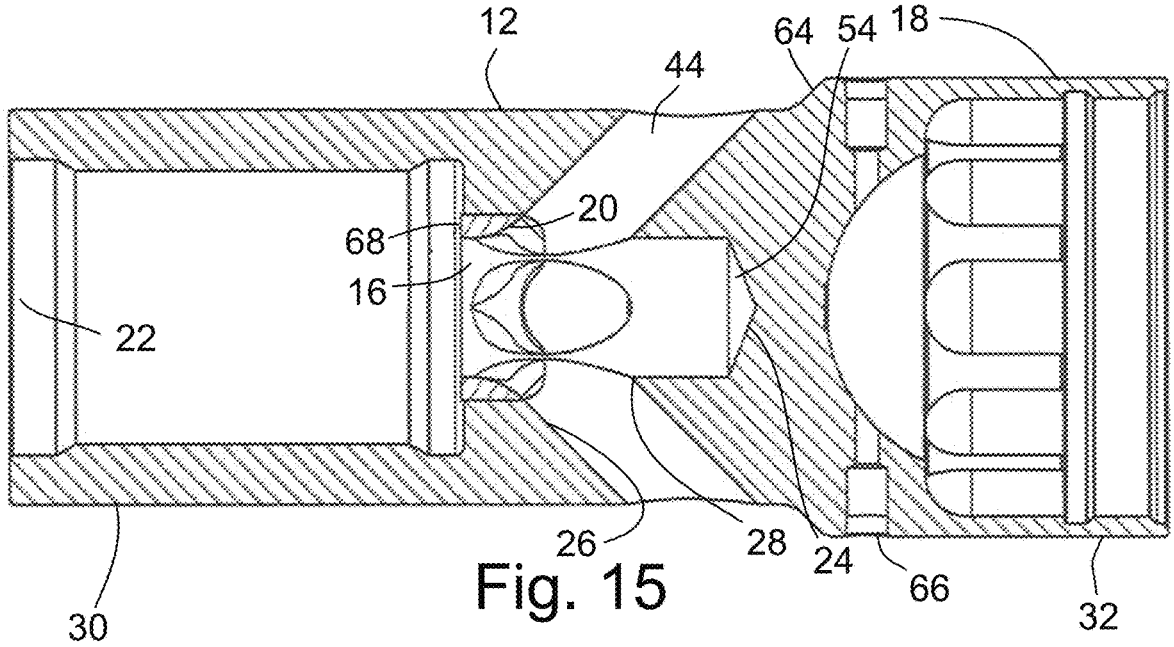
FIG. 15 is a side section view of the modified flow diverter of FIG. 14 including the insert.

FIG. 13 is a side section view of another prior art flow diverter. In FIGS. 13-16 the closed end connector 32 is a Constant Velocity drive joint. FIG. 14 is a side section view of the flow diverter modified to receive an insert as shown in FIG. 15. This version has an insert contacting the angled flow channels 44 only at one side of the intersection with the bore 16, as in FIGS. 1-4. In addition to an expansion 62 of the bore 16 to receive the insert, FIG. 14 also shows an optional modification of the outer surface 18 of the housing 12 at a transition area 64 between wider and narrower portions of the housing. This modification reduces a slope of the transition area 64 to, in this embodiment, 45 degrees instead of the steeper slope previously present. These modifications mitigate erosion on the outside of the port and create a flow stream with minimum recirculation and change in velocity. Some of these modification are simple but do add a significant performance increase.

To install an insert 14, the housing 12 can be machined first and the internal diameter recorded. The insert 14 can be formed with a slightly higher outer diameter, for example 0.003 inches larger. Friction paste can be used and the housing can be heated, for example to 375° C., for example using an induction heater, to expand the housing to allow the insert to be installed. Alignment tools can be used to ensure the insert is properly located and the housing is allowed to cool to shrink fit. In the embodiment shown in FIG. 15, there is a 0.03 inch projection 68 from the open end portion of the insert that is trimmed flush after the shrink fit install.

Figure 16:
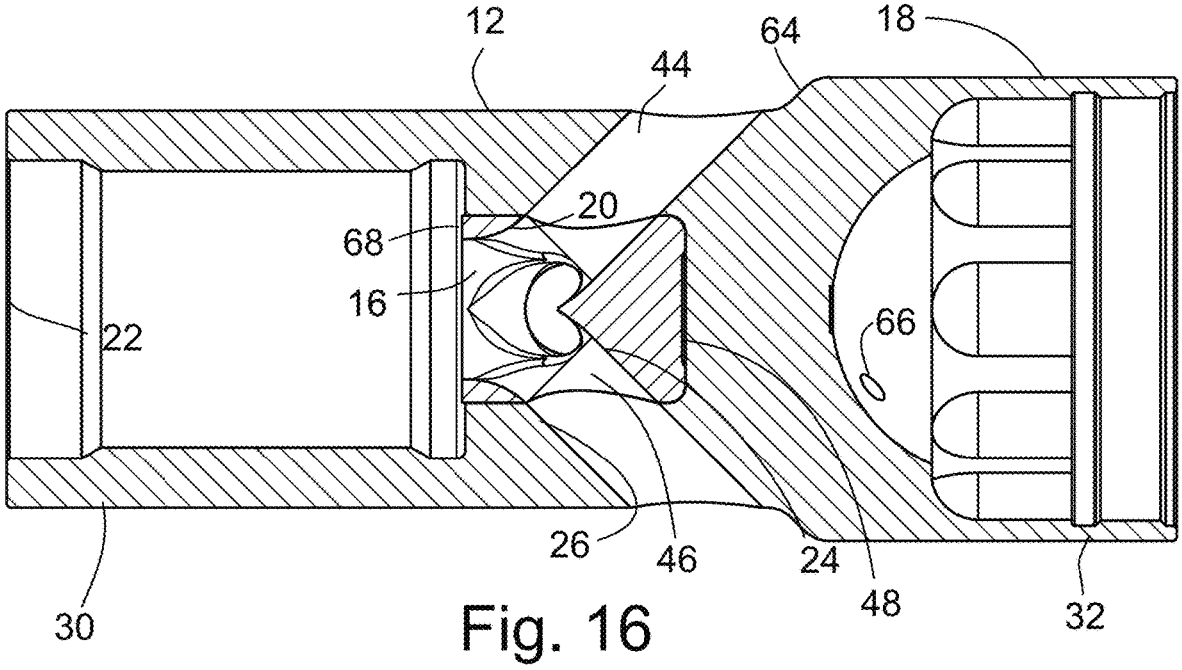
FIG. 16 is another modified flow diverter based on the flow diverter of FIG. 13, this one including an insert as shown in FIG. 12.

FIG. 16 is another modification of the prior art flow diverter of FIG. 13, this modification having a full insert as in FIGS. 6-8 and 10-12. In addition to the modification of the transition area 64, this one also has a further optional modification in that lube ports 66 are moved to a circumferential position at a 45 degree angle with respect to the angled flow channels 44 instead of being at a circumferential position matching a flow channel.

The flow diverter embodiments disclosed here would also work for flow diverters with flow in the opposite direction. In this case, the fillets would still prevent cavitation downstream of the change in angle of the flow, but this downstream direction would now be within the angled flow channels 44 and not within the bore 16.

Figure 17:
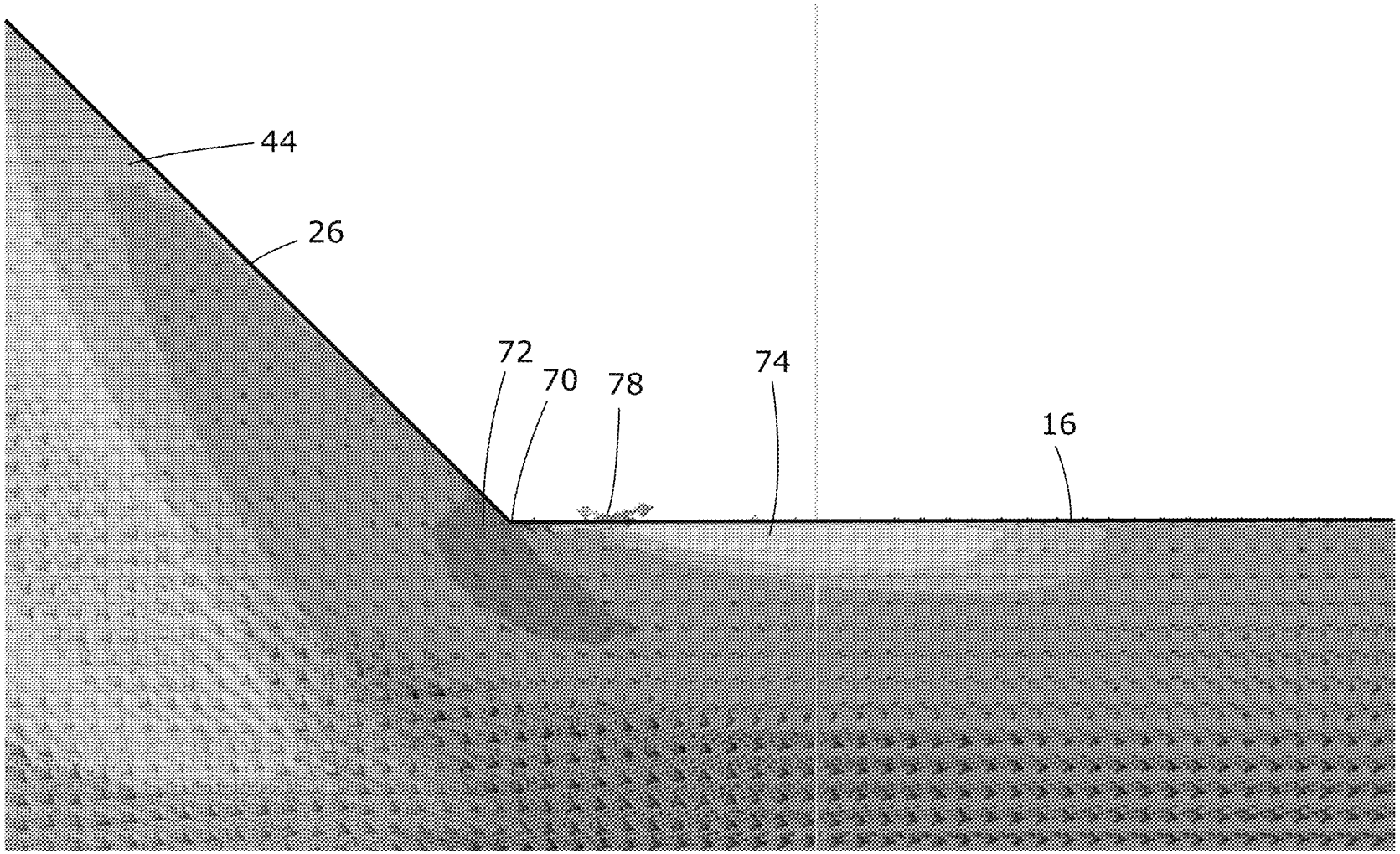
FIG. 17 is a frame of a simulation showing flow in a closeup of a prior art flow diverter.
Figure 18:
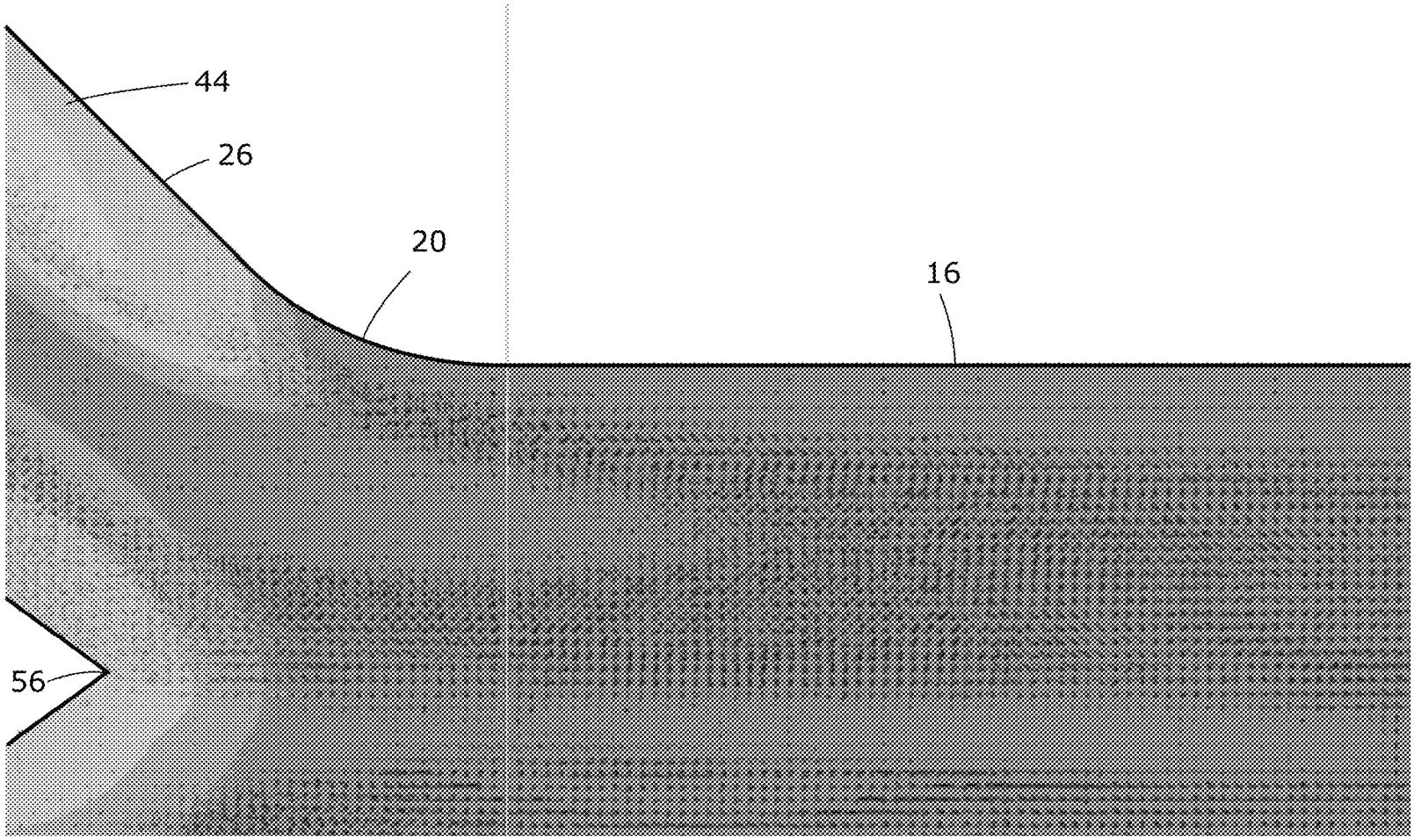

FIGS. 17 and 18 show simulations of fluid flow in flow diverters. FIG. 17 shows flow in a prior art flow diverter with a sharp angle 70 between the flow channel 44 and the bore 16. The shading, other than the light shade representing solid matter or space not considered part of the flow path, represents speed of flow, with darker being faster and lighter being slower. Arrows, where visible, represent direction of flow. It should be noted that some areas may appear darker due to the presence of arrows. As can be seen in FIG. 17 there is an area of high flow 72 near the sharp angle 70 between the bore 16 and flow channel 44 and an area of slow flow 74 downstream of the sharp angle. A recirculating flow area 78 can be seen also downstream of sharp angle 70. There are 4 or 5 arrows that stand out as not part of the bulk flow.

FIG. 18 shows flow in a modified diverter with a curved surface 20 between the flow channel 44 and the bore 16. This simulation also includes a tip 56 and the view is not as close up as in FIG. 17. As in FIG. 17, some areas may appear darker due to the presence of arrows, and the arrows are smaller in this figure. As can be seen in FIG. 18, in the modified flow diverter the dark and light areas near the intersection of the bore 16 with the flow channels 44 are diminished or eliminated.

Figure 19:
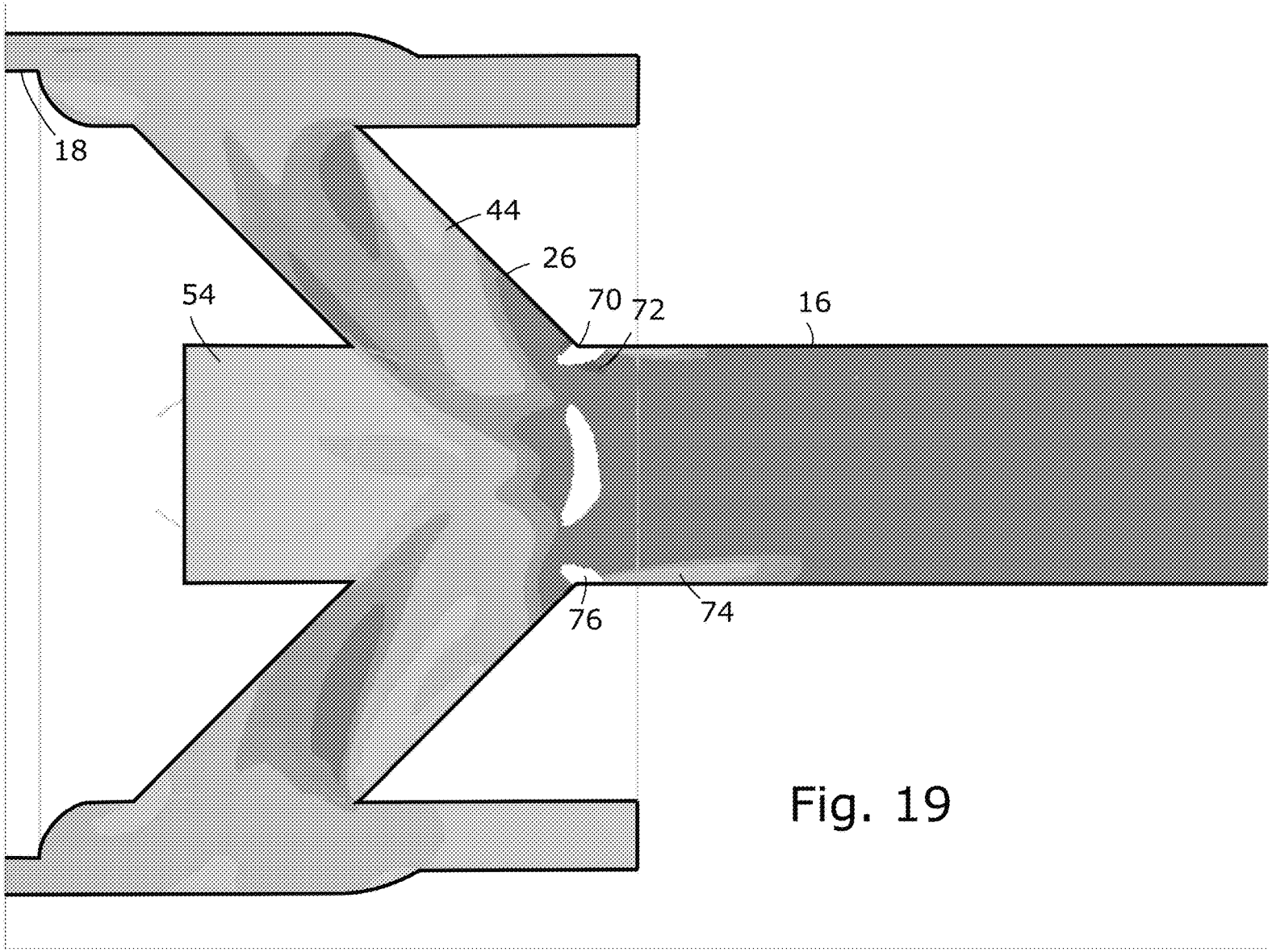
FIG. 19 is a frame of a simulation showing flow and cavitation areas in a frame of a simulation of a prior art flow diverter.

FIG. 19 shows a more full simulation view of a prior art flow diverter and omits the arrows showing flow direction. In this simulation, shading, other than pure white and the light shade, represent flow speed as in FIGS. 17 and 18, and the white areas 76, represent areas under 2 psi. This is a frame of a multi-frame simulation. The areas 76 under 2 psi are present in all frames and fairly consistent in size.

Figure 20:
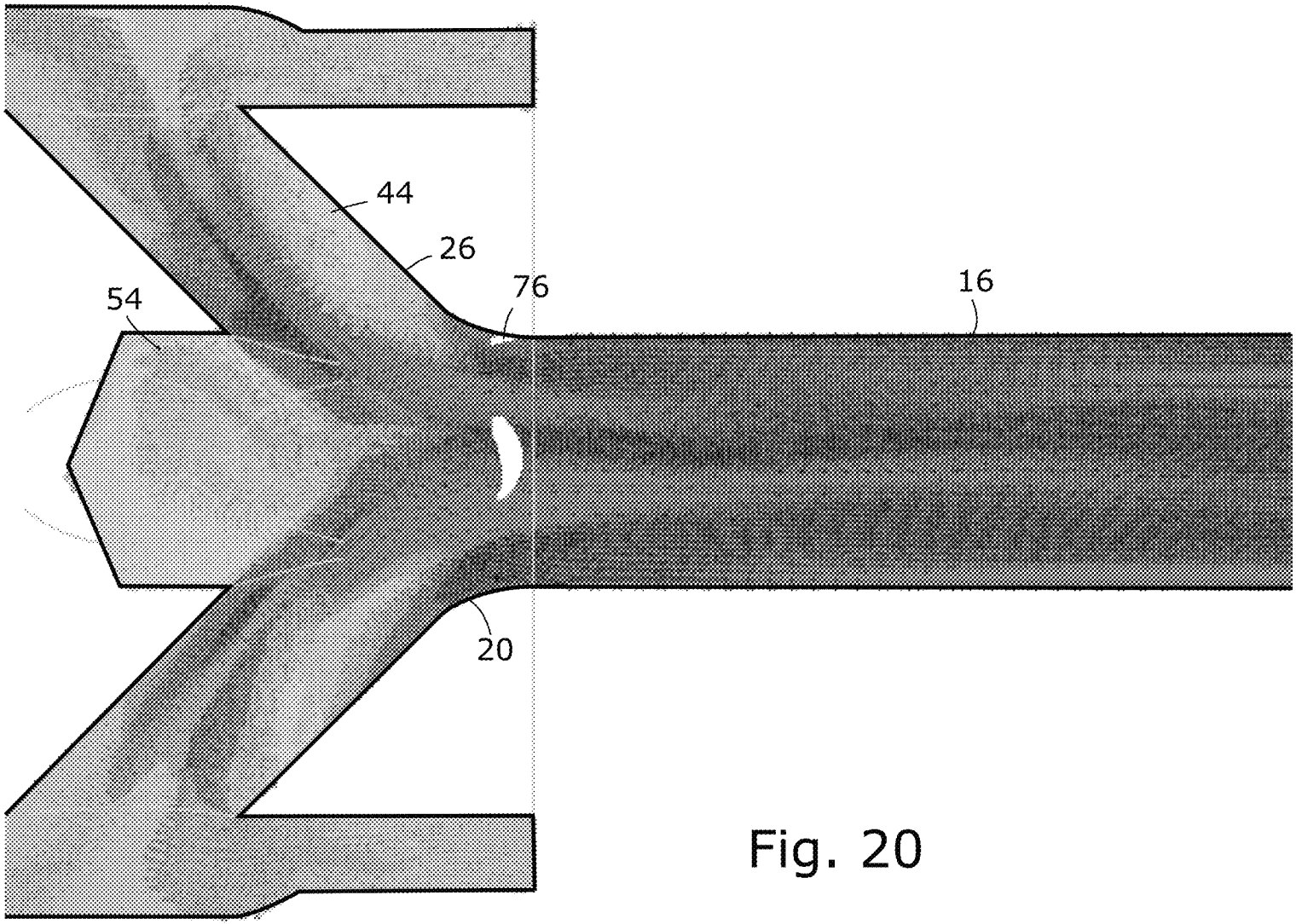
FIG. 20 is a frame of a simulation showing flow and low pressure areas in a frame of a simulation of a modified flow diverter having rounded connections between flow channels and bore but still having a void behind the intersection of the flow channels and bore.

FIG. 20 shows a simulation of a flow diverter with curved areas 20 between the bore 16 and flow channels 44, while still having a void 54. Arrows show flow direction but are too small to be easily seen. Shades represent the same information as in FIG. 19, but the arrows make some areas appear darker. The areas 76 in this case show areas below 12 psi. Even with the higher threshold of 12 psi, these areas 76 are smaller than those under the 2 psi threshold in FIG. 19 and do not show up in all frames.

Figure 21:
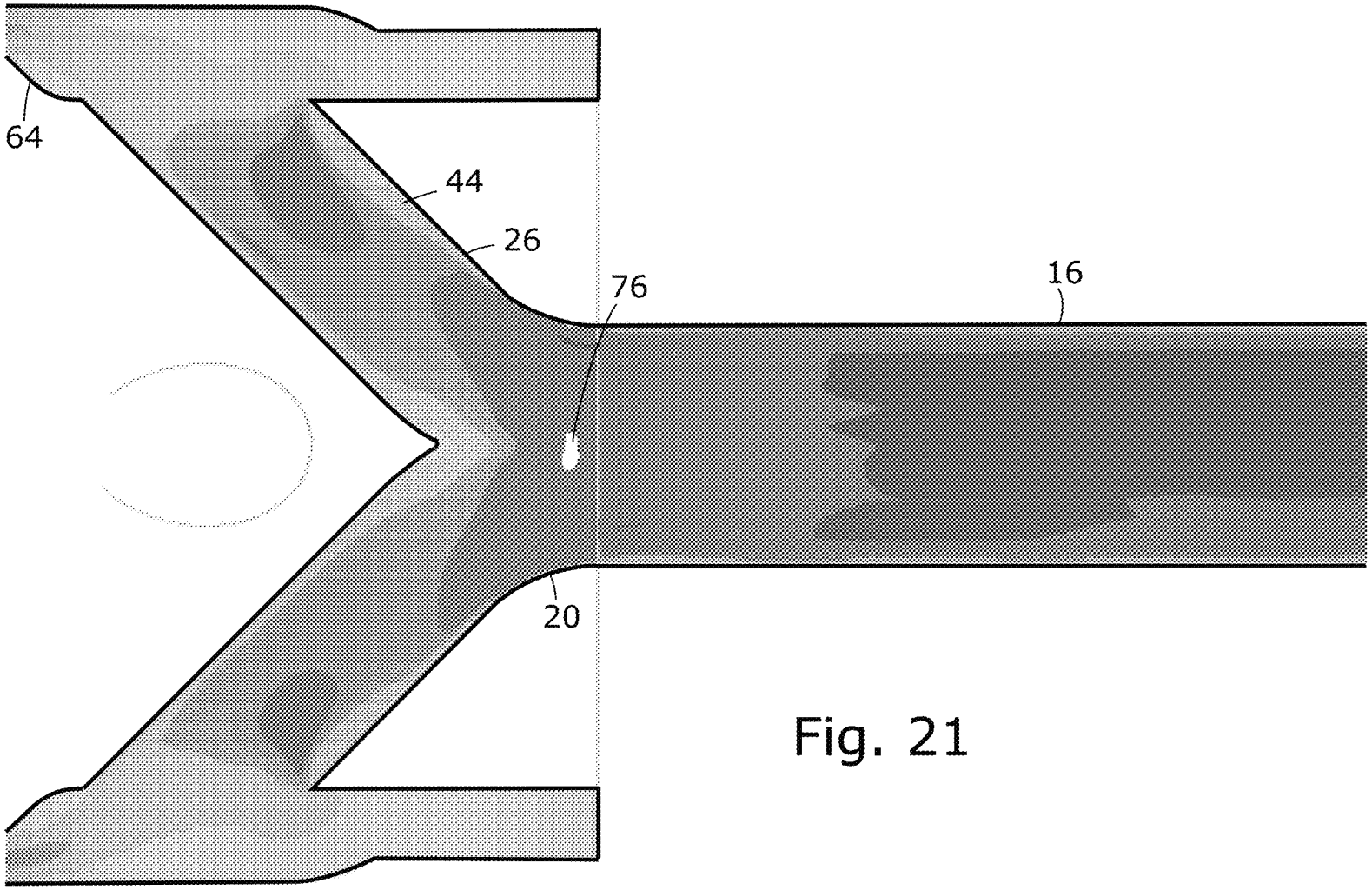
FIG. 21 is an initial frame of a simulation showing flow and cavitation areas in a modified flow diverter having rounded connections between flow channels and bore and with a void behind the intersection of the flow channels and bore filled in, the cavitation areas appearing in this initial frame but quickly disappearing.

FIG. 21 shows an initial frame of a simulation of a flow diverter having a curved surface 20 and a tip 56. Shades represent the same information as in FIG. 19. The white areas 76 quickly disappear in subsequent frames.

The areas 76 representing the volume below a a pressure threshold represents the "Volume fraction" (local area in the flow regime) below that threshold. threshold. The pressure threshold of 2 psi was estimated to be the pressure at which cavitation will form in the examples simulated. Using the "Volume fraction" method doesn't capture all the cavitation in the flow, only volumes or areas below the set pressure which allows us to estimate where cavitation will occur based on the liquid vapour phase transition of water @ 60° C. Other onset forms of cavitation will also occur. Modeling fine areas of shear or vortex cavitation require a very fine mesh and lots of computational horsepower. We could only find the large areas at this time. In the unmodified parts shown in FIG. 19 the frame shown is from a point in time in the simulation after some time has elapsed to allow the flow to stabilize, and the areas 76 below 2 psi remain. In the modified part shown in FIG. 21 they soon disappear. The areas 76 of pressure below 12 psi, in the frame of FIG. 20 from the simulation for the part with curved areas 20 and void 54, are not present in all frames. Even in the frame shown, the area 76 is smaller than the 2 psi area for the unmodified part as shown in FIG. 19.

Specific pressure thresholds for cavitation formation will change with different conditions.

A simulation of the full insert design including closed end portion 48 produced no areas in the flow below 12 psi in steady state whereas a simulation of the insert with only the curved areas 20 produced areas from 12 psi down to 8 psi. 8-12 psi is above the cavitation point but it points to an improvement in the flow regime.

In addition to the simulation results, a flow diverter with fillets 20 and a tip 56 has been tested with good results.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A flow diverter for use in a downhole drilling motor, the flow diverter comprising:

bore walls defining a bore;

inlet walls defining a flow channel acting as an inlet to the bore in use in the downhole drilling motor;

the flow diverter being configured to direct an inlet fluid flow at an inlet flow rate into the bore via the flow channel and to direct a downstream flow at a downstream flow rate in a downstream direction within the bore downstream of the inlet; and transitional wall portions forming a transition between the inlet walls and the bore walls at least in the downstream direction from the flow channel, the transitional wall portions being configured to be sufficiently smooth and to have sufficient radius of curvature to prevent cavitation within the bore at the transitional wall portions and immediately downstream of the transitional wall portions when fluid flows at the inlet flow rate into the bore via the flow channel and at the downstream flow rate in the downstream direction within the bore downstream of the flow channel.

2. The flow diverter of claim 1 in which the radius of curvature is greater than one third of a diameter of the flow channel.

3. The flow diverter of claim 1 in which the radius of curvature is greater than one half of a diameter of the flow channel.

4. The flow diverter of claim 1 in which the radius of curvature is greater than three quarters of a diameter of the flow channel.

5. The flow diverter of claim 1 in which the flow diverter comprises a housing and an insert, the insert comprising the transitional wall portions, and the housing comprising the inlet walls or the bore walls.

6. The flow diverter of claim 5 in which the insert comprises the transitional wall portions and at least a portion of the bore walls downstream of the inlet, and the housing comprises the inlet walls.

7. The flow diverter of claim 5 in which the housing comprises the inlet walls and the bore walls.

8. The flow diverter of claim 1 in which the flow diverter comprises a housing and an insert, the insert comprising the transitional wall portions and defining portions of the inlet walls extending fully around the flow channel.

9. The flow diverter of claim 8 in which the flow channel is one of plural flow channels defined by additional inlet walls, the inlet walls and the additional inlet walls converging to a point upstream of the bore to form a pyramid-shaped tip.

10. The flow diverter of claim 9 in which a cross section of the pyramid-shaped tip parallel to the flow direction has a concave profile.

11. The flow diverter of claim 1 in which the flow channel is one of plural flow channels defined by additional inlet walls, the inlet walls and the additional inlet walls converging to a point upstream of the bore to form a pyramid-shaped tip.

12. The flow diverter of claim 11 in which a cross section of the pyramid-shaped tip parallel to the flow direction has a concave profile.

13. The flow diverter of claim 1 in which the flow channel extends between the bore and an exterior surface of a tubular, the tubular having a first diameter at an upstream end of the tubular larger than a second diameter of the tubular at the flow channel, the tubular defining a transition area between the first diameter and the second diameter, the transition area having a slope of 45 degrees or less.

14. An insert for a flow diverter for use in a downhole drilling motor, comprising:

a central bore;

curved portions adjacent to the central bore configured to, when the insert is inserted in the flow diverter, form fillets connecting the central bore to flow channels defined by the flow diverter, the flow channels being angled relative to the central bore and connecting the central bore to an exterior surface of the flow diverter when the insert is inserted in the flow diverter; and inlet wall portions extending fully around each of the flow channels and converging to a point upstream of the central bore to form a pyramid-shaped tip.

15. The flow diverter of claim 14 in which a cross section of the pyramid-shaped tip parallel to the flow direction has a concave profile.

16. A flow diverter for use in a downhole drilling motor, the flow diverter comprising:

bore walls defining a bore;

outlet walls defining a flow channel acting as an outlet to the bore in use in the downhole drilling motor;

the flow diverter being configured to direct an outlet fluid flow at an outlet flow rate from the bore into the flow channel and to direct a bore flow at a bore flow rate in a downstream direction within the bore in an upstream direction opposite to the downstream direction from the outlet; and transitional wall portions forming a transition between the outlet walls and the bore walls at least in the upstream direction from the flow channel, the transitional wall portions being configured to be sufficiently smooth and to have sufficient radius of curvature to prevent cavitation within the flow channel at the transitional wall portions and immediately downstream of the transitional wall portions when fluid flows at the outlet flow rate from the bore into the flow channel and at the bore flow rate in the downstream direction within the bore upstream of the flow channel.

* * * * *